US007494444B2

(12) United States Patent
Adams

(10) Patent No.: US 7,494,444 B2
(45) **Date of Patent: *Feb. 24, 2009**

(54) RECREATIONAL STRUCTURE USING A SLEEVE-JOINT COUPLING

(75) Inventor: Craig Adams, Portland, OR (US)

(73) Assignee: CA06, LLC, Portland, OR (US)

( * ) Notice: Subject to any disclaimer, the term of this patent is extended or adjusted under 35 U.S.C. 154(b) by 232 days.

This patent is subject to a terminal disclaimer.

(21) Appl. No.: 10/908,469

(22) Filed: May 12, 2005

(65) Prior Publication Data

US 2006/0128529 A1 Jun. 15, 2006

Related U.S. Application Data

(63) Continuation-in-part of application No. 10/905,105, filed on Dec. 15, 2004.

(60) Provisional application No. 60/530,054, filed on Dec. 16, 2003.

(51) Int. Cl.
*A63B 5/11* (2006.01)
*A63B 26/00* (2006.01)

(52) U.S. Cl. ..... 482/27; 482/23

(58) Field of Classification Search ..... 482/27–29, 482/35–37

See application file for complete search history.

(56) References Cited

U.S. PATENT DOCUMENTS

| | | | |
|---|---|---|---|
| 774,393 | A | 11/1904 | Palmer |
| 959,973 | A | 5/1910 | Tomkins |
| 1,488,244 | A | 3/1924 | Hinton |
| 1,830,262 | A | 11/1931 | Carlson |
| 1,850,049 | A | 3/1932 | Cornell, Jr. |
| 1,982,498 | A | 11/1934 | Cornell, Jr. |
| 1,992,312 | A | 2/1935 | Kuehn |

(Continued)

FOREIGN PATENT DOCUMENTS

AU 2004 100729 A4 9/2004

OTHER PUBLICATIONS

L.H. Teh et al., "Strength of Welded T-Joint Truss Connections Between Equal Width Cold-Formed RHS," Research Report No. R831, Dept. of Civil Engineering, Centre For Advanced Structural Engineering, The University of Sydney, Aug. 2003.

(Continued)

*Primary Examiner*—Fenn C Mathew
(74) *Attorney, Agent, or Firm*—Harness, Dickey & Pierce, P.L.C.

(57) ABSTRACT

A recreational structure, such as a trampoline frame, can be quickly and reliably assembled using a sleeve-joint coupling having a "T" configuration. A first arm member and an aperture that is formed in the sleeve-joint coupling are disposed in an opposite relationship. A second arm member and a third arm member are disposed in an opposite relationship with each other. The first arm member receives one end of a vertical frame member of the recreational structure, while the aperture receives one end of a vertical pole member of, for example, a safety enclosure. The second and third arm members each receive one end of a horizontal frame member of the recreational structure. A tension member applies a force between a vertical frame member and a corresponding vertical pole member that compresses the vertical frame member toward the corresponding vertical pole member.

16 Claims, 12 Drawing Sheets

U.S. PATENT DOCUMENTS

| | | | | | |
|---|---|---|---|---|---|
| 2,128,720 | A | | 8/1938 | Tweedale | |
| 2,809,383 | A | * | 10/1957 | Fenner et al. | 482/28 |
| 2,858,551 | A | | 11/1958 | Sidlinger | |
| 2,931,129 | A | | 4/1960 | Boniface | |
| 3,502,357 | A | | 3/1970 | Wagner | |
| 3,988,872 | A | | 11/1976 | Adamson et al. | |
| 4,139,192 | A | | 2/1979 | McNeil | |
| 4,157,801 | A | | 6/1979 | Elmer | |
| RE30,344 | E | | 7/1980 | McNeil | |
| 4,339,123 | A | | 7/1982 | Rich | |
| 4,359,851 | A | | 11/1982 | Daniels | |
| 4,370,790 | A | | 2/1983 | Rodaway | |
| 4,386,772 | A | * | 6/1983 | Wu | 482/28 |
| 4,433,838 | A | | 2/1984 | Gordon | |
| 4,480,941 | A | | 11/1984 | Gilb et al. | |
| 4,514,107 | A | | 4/1985 | Moreno | |
| 4,540,309 | A | | 9/1985 | Hansson | |
| 4,569,515 | A | | 2/1986 | Gordon | |
| 4,572,695 | A | | 2/1986 | Gilb | |
| 4,644,892 | A | | 2/1987 | Fisher | |
| 4,776,581 | A | | 10/1988 | Shepherdson | |
| 4,863,156 | A | | 9/1989 | Shaw | |
| 4,885,883 | A | | 12/1989 | Wright | |
| D328,119 | S | | 7/1992 | Matsch | |
| D328,940 | S | | 8/1992 | Matsch | |
| D330,741 | S | | 11/1992 | Matsch | |
| D330,742 | S | | 11/1992 | Matsch | |
| D330,744 | S | | 11/1992 | Matsch | |
| 5,230,581 | A | | 7/1993 | Deng | |
| 5,299,839 | A | | 4/1994 | Mogavero | |
| 5,364,313 | A | | 11/1994 | Nickelson | |
| 5,469,678 | A | | 11/1995 | Zamerovsky | |
| D376,405 | S | | 12/1996 | Strawcutter et al. | |
| 5,617,697 | A | | 4/1997 | Erwin | |
| 5,810,695 | A | | 9/1998 | Sass | |
| 5,833,557 | A | | 11/1998 | Cole | |
| 5,876,311 | A | | 3/1999 | Coates et al. | |
| 5,921,049 | A | | 7/1999 | Sugiyama | |
| 5,941,798 | A | * | 8/1999 | Coan et al. | 482/27 |
| 6,001,045 | A | | 12/1999 | Gift et al. | |
| 6,017,292 | A | | 1/2000 | Gift et al. | |
| 6,032,431 | A | | 3/2000 | Sugiyama | |
| 6,053,845 | A | * | 4/2000 | Publicover et al. | 482/35 |
| 6,110,074 | A | | 8/2000 | Tacquet | |
| 6,135,921 | A | | 10/2000 | Holland et al. | |
| 6,162,061 | A | | 12/2000 | Taylor | |
| 6,261,207 | B1 | * | 7/2001 | Publicover et al. | 482/27 |
| 6,319,174 | B1 | | 11/2001 | Alexander | |
| 6,402,414 | B1 | | 6/2002 | Kanodia et al. | |
| 6,478,039 | B2 | | 11/2002 | Suh | |
| 6,607,468 | B1 | | 8/2003 | Nichols, Jr. et al. | |
| 6,742,202 | B2 | | 6/2004 | Jones | |
| 6,748,962 | B2 | * | 6/2004 | Miller | 135/130 |
| 6,802,169 | B2 | | 10/2004 | Simmons | |
| 6,846,271 | B2 | | 1/2005 | Publicover | |
| 7,182,713 | B2 | | 2/2007 | Wang et al. | |
| 2002/0137598 | A1 | | 9/2002 | Publicover et al. | |
| 2003/0026645 | A1 | | 2/2003 | Hoke, Jr. | |
| 2003/0036460 | A1 | | 2/2003 | Publicover | |
| 2003/0104905 | A1 | | 6/2003 | Publicover | |
| 2004/0091307 | A1 | * | 5/2004 | James | 403/188 |
| 2004/0121883 | A1 | | 6/2004 | Publicover | |
| 2004/0147370 | A1 | | 7/2004 | Wang et al. | |
| 2004/0171461 | A1 | | 9/2004 | Alexander | |
| 2004/0171462 | A1 | | 9/2004 | Alexander | |
| 2004/0176214 | A1 | | 9/2004 | Yuch | |
| 2005/0032609 | A1 | | 2/2005 | Nissen et al. | |
| 2005/0037896 | A1 | | 2/2005 | Publicover | |
| 2005/0084627 | A1 | | 4/2005 | Alexander | |
| 2005/0226683 | A1 | | 10/2005 | Herb | |

OTHER PUBLICATIONS

H176, Johnstone, Jr., "Slip Tee Pipe Fitting," Dec. 2, 1986.

* cited by examiner

VIEW A

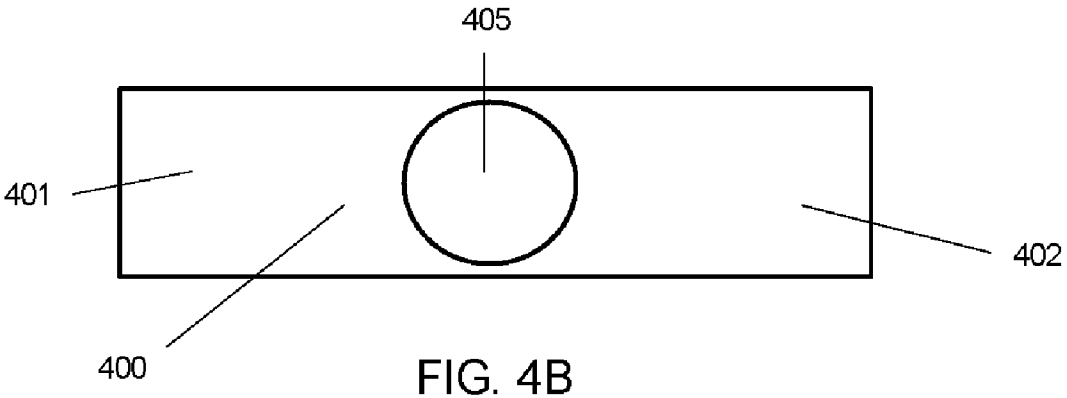
FIG. 4B
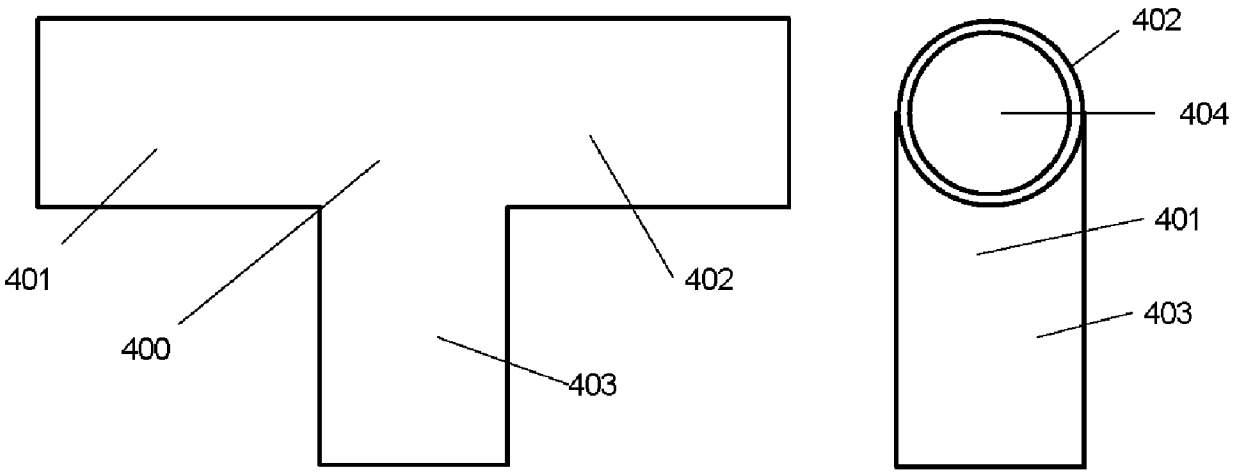
FIG. 4C
FIG. 4A

RECREATIONAL STRUCTURE USING A SLEEVE-JOINT COUPLING

CROSS-REFERENCE TO RELATED APPLICATION

The present patent application is a continuation-in-part (CIP) patent application of U.S. patent application Ser. No. 10/905,105, filed Dec. 15, 2004, entitled "Recreational Structure Using A Sleeve-joint Coupling," invented by Craig Adams, and incorporated by reference herein.

BACKGROUND OF THE INVENTION

1. Field of the Invention

The present invention relates to recreational structures. More particularly, the present invention relates to a frame arrangement for a recreational structure, such as a trampoline, that uses a sleeve-joint coupling.

2. Description of the Related Art

Recreational structures having frames, such as trampolines, are well-known. For example, a trampoline has a horizontal frame to which a rebounding surface is attached and a plurality of vertical frame members, or legs, that support the horizontal frame and rebounding surface above the ground. While the horizontal and vertical frame portions of a trampoline could be fabricated to be one unitary structure, such a unitary structure is cumbersome when the trampoline frame is transported to a place where the trampoline is used. Accordingly, trampoline frames are typically formed from a plurality of pieces that are fastened together at the time a trampoline is assembled.

A desirable characteristic for all trampoline frames formed from a plurality of pieces is that the various pieces are attached or joined to each other using a technique that is simple, quick to assemble and is reliable.

BRIEF SUMMARY OF THE INVENTION

The present invention provides a technique for joining structural components of a recreational structure, such as a trampoline, that is simple, quick to assemble and is reliable.

The present invention provides a recreational structure frame system that includes a plurality of horizontal frame members, at least one vertical frame member, at least one vertical pole member, and at least one sleeve-joint coupling. Each horizontal frame member has two ends. Similarly, each vertical frame member has two ends, and each vertical pole member has two ends. In one exemplary embodiment, at least one sleeve-joint coupling has first, second and third arm members arranged to substantially form a T configuration and an aperture that is formed in the sleeve-joint coupling. That is, the first arm member and the aperture are disposed in an opposite relationship with respect to each other, and the second arm member and the third arm member are disposed in an opposite relationship with each other. In another exemplary embodiment, at least one sleeve-joint coupling includes a side sleeve member having the aperture. The first arm member receives one end of a vertical frame member. The aperture receives one end of a vertical pole member. The second and third arm members each receive one end of a horizontal frame member. The vertical pole member received by the aperture extends through the sleeve-joint coupling into an inner portion of the vertical frame member received by the first arm of the sleeve-joint coupling. A tension member, such as a chain, cord, rope, cable or strap, applies a force between a vertical frame member and a corresponding vertical pole member that compresses the vertical frame member toward the corresponding vertical pole member. In one exemplary embodiment, the tension member is internal to the vertical frame member and the corresponding vertical pole member and the tension member extends through an opening in the vertical pole member. A ground-fastening device, such as a stake, is coupled to the portion of the tension member that extends through the opening in the vertical frame member and is fasten to the ground.

The vertical pole member can be part of, for example, a safety enclosure, in which case the safety enclosure can include a plurality of vertical pole members, such that each vertical pole member is received into the aperture of a sleeve-joint coupling. A plurality of horizontal support members can be coupled to two adjacent vertical pole members, thereby forming the safety enclosure. In one exemplary embodiment, the vertical pole member is configured to substantially form an arch.

One exemplary embodiment of a sleeve-joint coupling according to the present invention includes a fourth arm member, in which case the aperture is disposed at an end of the fourth arm member. A frame tension member can be coupled between adjacent sleeve-joint couplings that applies a force to the adjacent sleeve-joint couplings and forces the adjacent sleeve-joint couplings toward each other.

BRIEF DESCRIPTION OF THE DRAWINGS

The present invention is illustrated by way of example and not by limitation in the accompanying figures in which like reference numerals indicate similar elements and in which:

FIGS. 4A-4C respectively show a side view, a top view and an end view of a second exemplary embodiment of a sleeve-joint coupling for a trampoline frame according to the present invention; FIGS. 4A-4C respectively show a side view, a top view and an end view of a second exemplary embodiment of a sleeve-joint coupling for a trampoline frame according to the present invention;

DETAILED DESCRIPTION OF THE INVENTION

Figure 1:
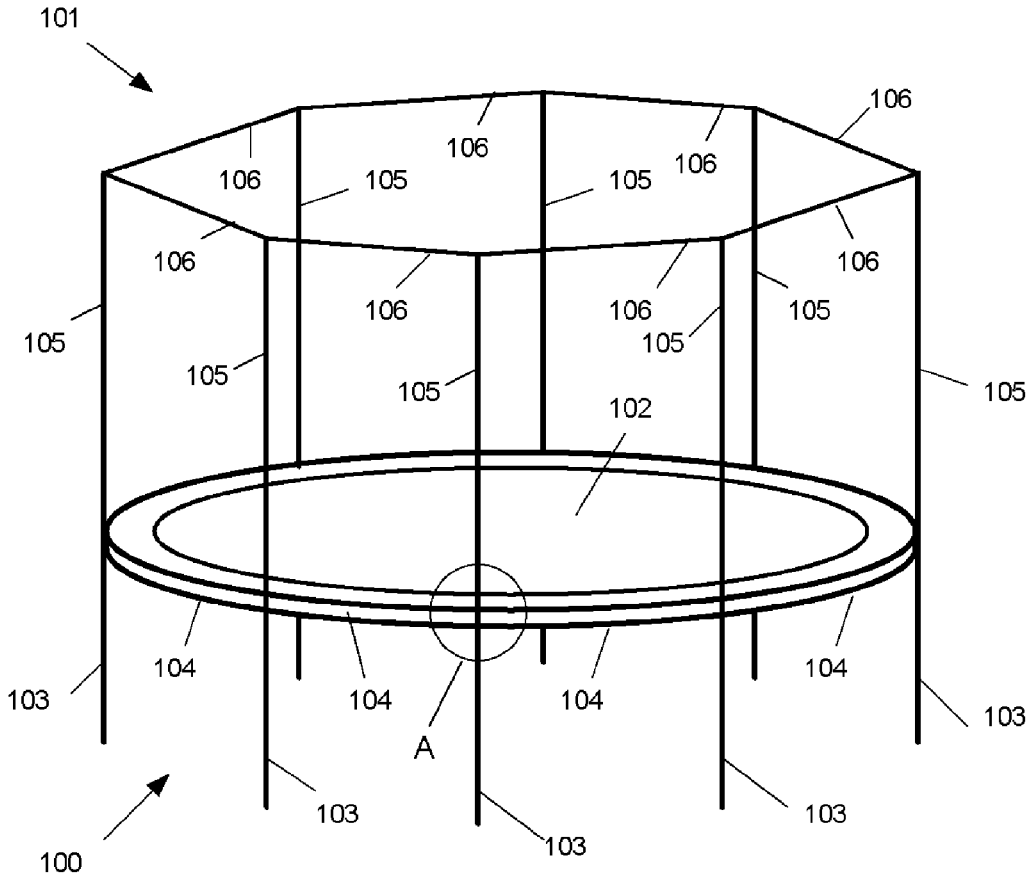
FIG. 1 depicts a perspective view of an exemplary trampoline having an exemplary safety enclosure.

FIG. 1 depicts a perspective view of an exemplary trampoline 100 having an exemplary safety enclosure 101. Trampoline 100 includes a rebounding surface 102 and a frame structure having vertical frame members 103 and a circular frame that can be formed from a plurality of circular frame members 104. Vertical frame members 103 and circular frame members 104 are typically made from hollow metal tubing having sufficient strength to bear the stresses and loads that are associated with trampolines. Safety enclosure 101 includes a frame structure having vertical pole members 105 and horizontal support members 106. A horizontal support member 106 is connected between adjacent vertical pole members in a substantially inflexible manner. A structural member that is suitable for both vertical pole members 105 and horizontal support members 106 is disclosed by U.S. Pat. No. 6,450,187 B1 to Lin et al., which is incorporated by reference herein.

Complete details of trampoline 100 and safety enclosure 101 are not shown in FIG. 1 for simplicity. For example, safety enclosure includes a mesh- or netting-type of material that extends between adjacent vertical pole members 105 and between horizontal frame members 106 and circular frame member 104 that together with circular frame 104, vertical pole members 105 and horizontal support members 106 operate as a fence around rebounding surface 102 in order to keep a user on trampoline 100 and reduce the risk of injury to the user.

Figure 2C:
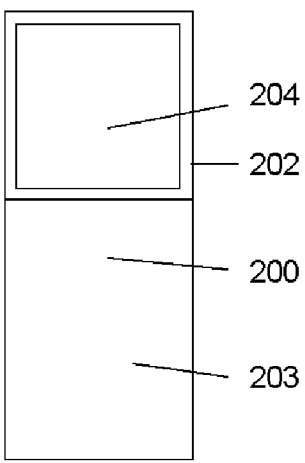
FIGS. 2A-2C respectively show a side view, a top view and an end view of the first exemplary embodiment of a sleeve joint coupling for a trampoline frame according to the present invention.
Figure 2B:
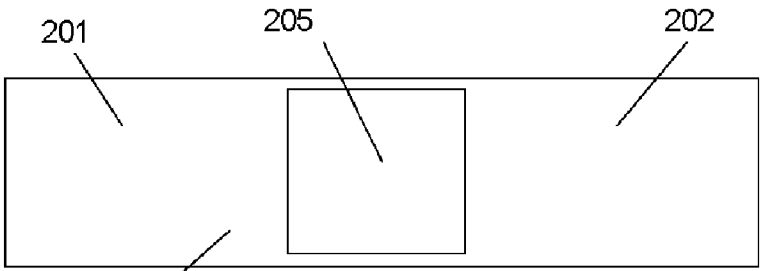
Figure 2A:
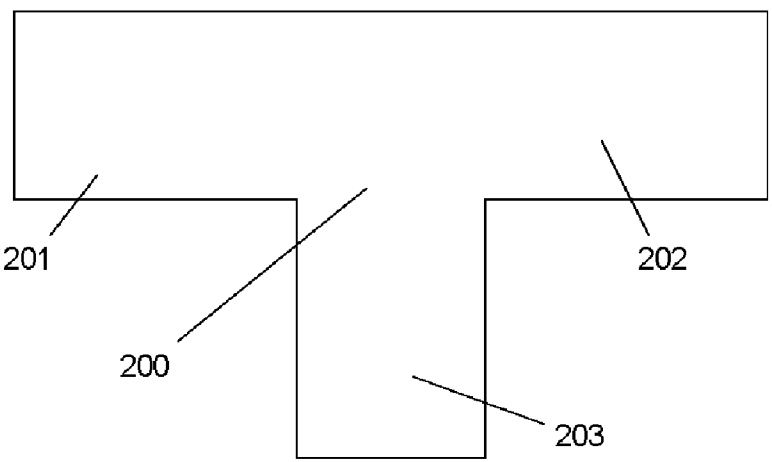
Figure 2D:
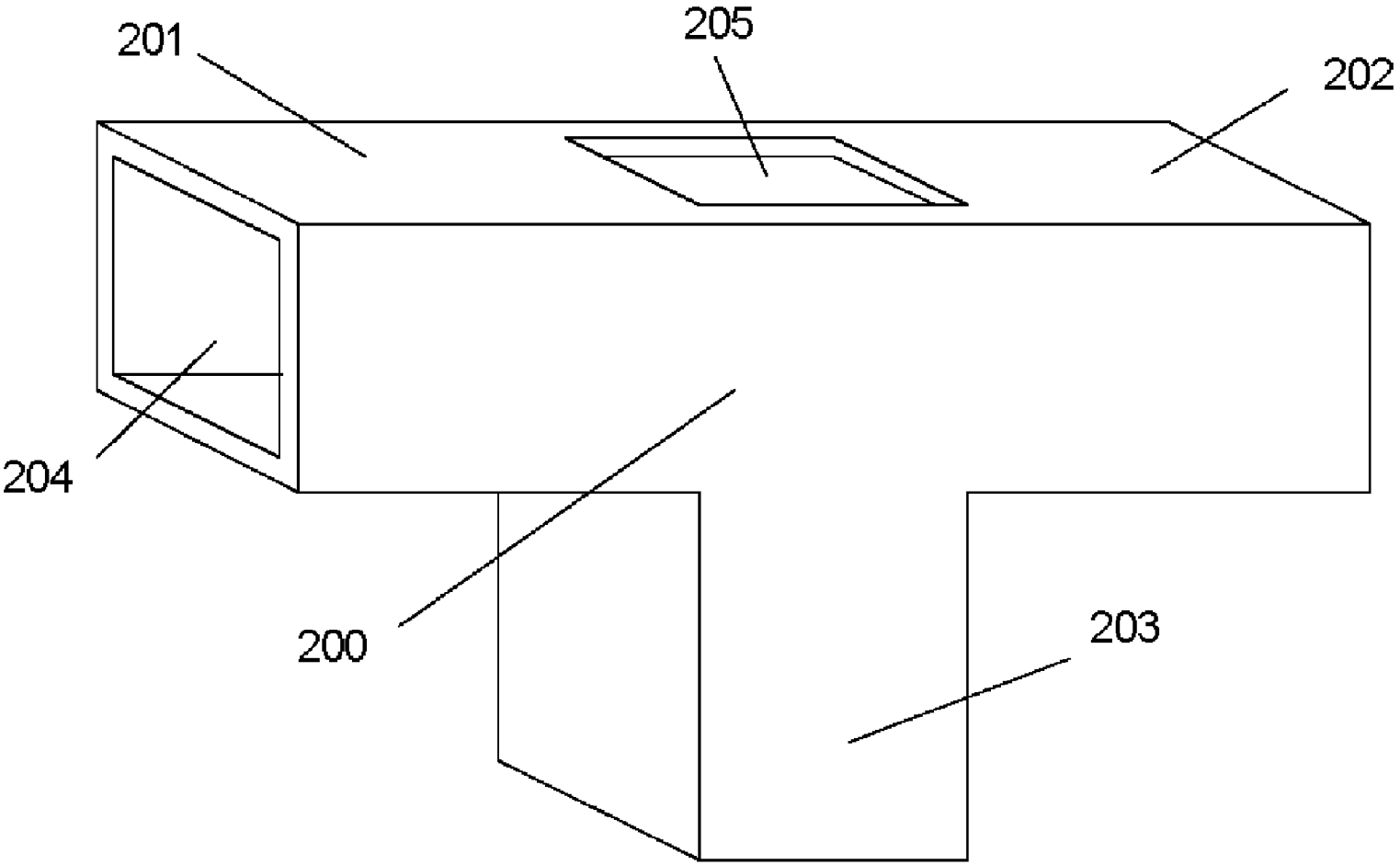
FIG. 2D shows a perspective view of the first exemplary embodiment of a sleeve joint coupling according to the present invention.

According to the present invention, vertical pole members 105 of safety enclosure 101 attach to the frame structure of trampoline 100 using a plurality of sleeve-joint couplings, of which one is indicated at A in FIG. 1. FIGS. 2A-2D and FIG. 3 show details of a first exemplary embodiment of a sleeve-joint coupling according to the present invention. In particular, FIGS. 2A-2C respectively show a side view, a top view and an end view of the first exemplary embodiment of a sleeve-joint coupling 200 for a trampoline frame according to the present invention. FIG. 2D shows a perspective view of sleeve-joint coupling 200. Sleeve joint coupling 200 is generally shaped as a "T" and includes three arm members 201-203, each having a generally square cross-sectional shape. Each arm member 201-203 receives a trampoline frame member (not shown in FIGS. 2A-2C) of similar cross-sectional shape into an opening 204 (FIGS. 2C and 2D). Sleeve joint coupling 200 includes an opening 205, shown in FIG. 2B, that receives a safety enclosure vertical pole member (not shown in FIGS. 2A-2C) having a generally square cross-sectional member.

Figure 3:
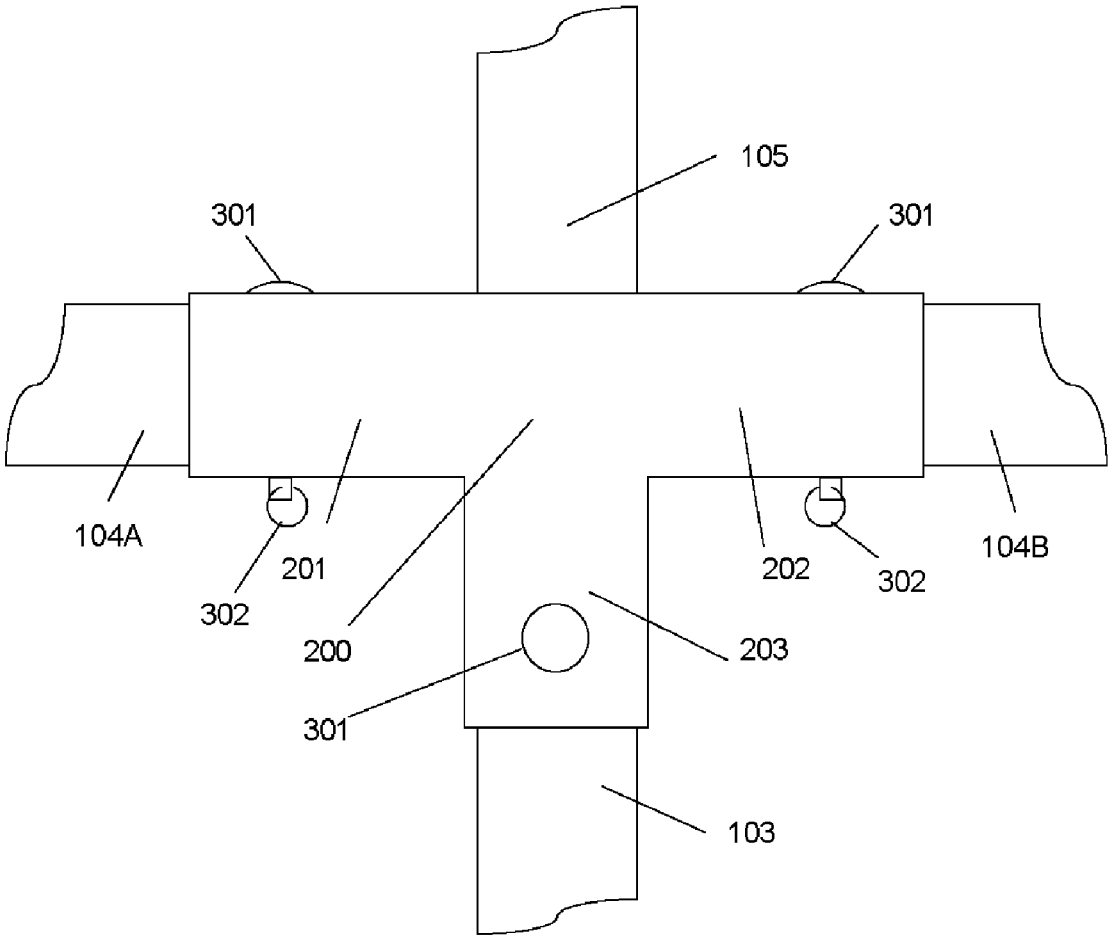
FIG. 3 shows details of a first exemplary embodiment of sleeve-joint coupling according to the present invention.

FIG. 3 depicts View A, shown in FIG. 1, in greater detail. In FIG. 3, sleeve-joint coupling 200 couples circular frame member 104A to circular frame member 104B and to vertical frame member 103. Circular frame members 104A and 104B are secured to sleeve-joint coupling 200 using, for example, pins 301 and cotter rings 302 (not shown in FIGS. 2A-2D). Alternatively, circular frame members 104A and 104B can be secured to sleeve-joint coupling 200 using sheet metal screws, and/or bolts and nuts. As yet another alternative, the inner surface of each arm member of sleeve-joint coupling can be threaded to engage complementary threading on each end of a circular frame member 104 and on one end of a vertical frame member 103. Additionally, a threaded connection between sleeve-joint coupling 200 and a frame member can be secured using a pin and cotter ring arrangement, a sheet metal screw and/or a bolt and nut.

Vertical pole member 105 of safety enclosure 101 is inserted into opening 205 (FIGS. 3B and 3D) and extends through sleeve-joint coupling 200 into vertical frame member 103 a distance that is sufficient to distribute any shearing and/or torquing forces that may be imparted to vertical pole member 105 along the inside of vertical frame member 103 so that vertical frame member 103 does not fail. Vertical pole member 105 can be secured in vertical frame member 103 using, for example, a pin 301 and a cotter ring (not shown). Alternatively, vertical pole member 105 is secured in vertical frame member 103 using a sheet metal screw and/or a bolt and nut.

FIGS. 4A-4C respectively show a side view, a top view and an end view of a second exemplary embodiment of a sleeve-joint coupling 400 for a trampoline frame according to the present invention. Sleeve-joint coupling 400 is generally shaped as a "T" and includes three arm members 401-403, each having a generally round cross-sectional shape. Each arm member 401-403 receives a trampoline frame member (not shown in FIGS. 4A-4C) of similar cross-sectional shape into an opening 404 (FIG. 4C). Sleeve-joint coupling 400 includes an opening 405, shown in FIG. 4B, that receives a safety enclosure vertical pole member (not shown in FIGS. 4A-4C) having a generally round cross-sectional member.

Figure 5B:
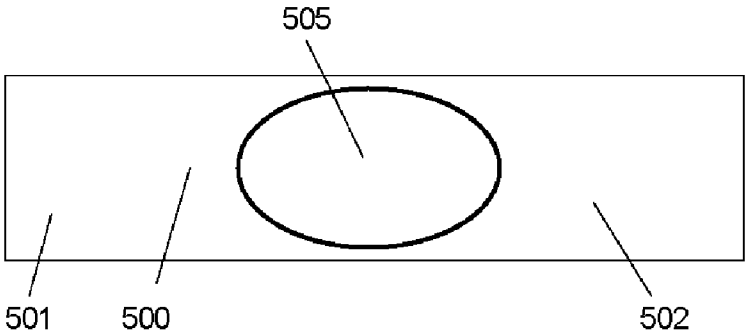
FIGS. 5A-5C respectively show a side view, a top view and an end view of a third exemplary embodiment of a sleeve-joint coupling for a trampoline frame according to the present invention.
Figure 5A:
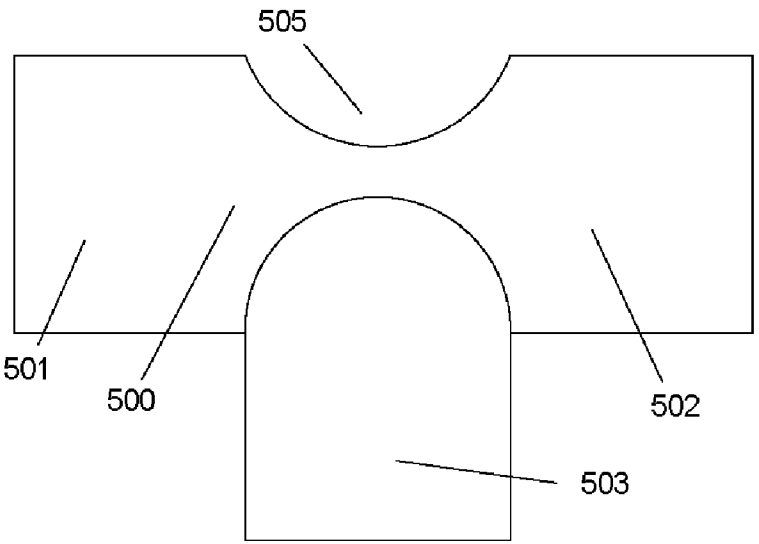
Figure 5C:
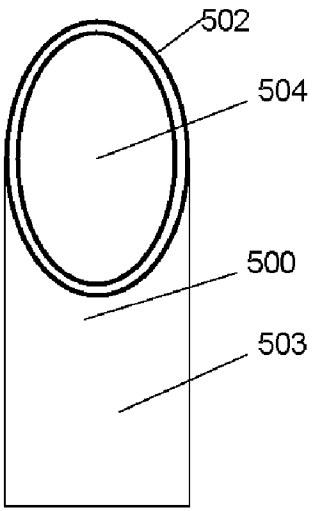

FIGS. 5A-5C respectively show a side view, a top view and an end view of a third exemplary embodiment of a sleeve-joint coupling 500 for a trampoline frame according to the present invention. Sleeve-joint coupling 500 is generally shaped as a "T" and includes three arm members 501-503, each having a generally oval cross-sectional shape. Each arm member 501-503 receives a trampoline frame member (not shown in FIGS. 5A-5C) of similar cross-sectional shape into an opening 504 (FIG. 5C). Sleeve-joint coupling 500 includes an opening 505, shown in FIG. 5B, that receives a safety enclosure vertical pole member (not shown in FIGS. 5A-5C) having a generally oval cross-sectional member.

Figure 6C:
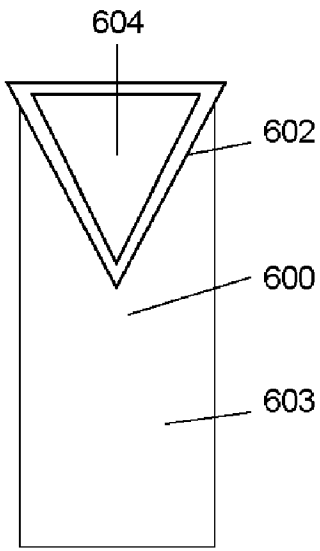
FIGS. 6A-6C respectively show a side view, a top view and an end view of a fourth exemplary embodiment of a sleeve-joint coupling for a trampoline frame according to the present invention.
Figure 6B:
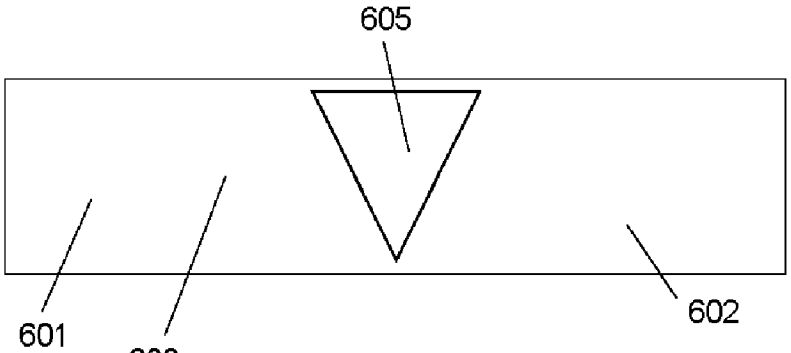
Figure 6A:
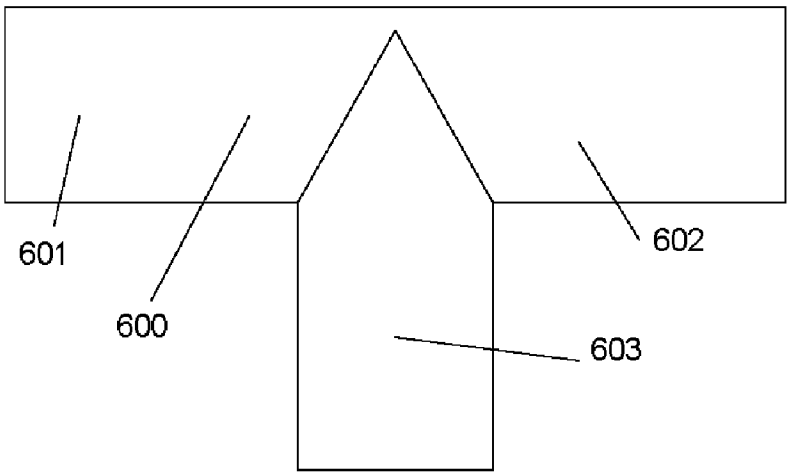

FIGS. 6A-6C respectively show a side view, a top view and an end view of a fourth exemplary embodiment of a sleeve-joint coupling 600 for a trampoline frame according to the present invention. Sleeve-joint coupling 600 is generally shaped as a "T" and includes three arm members 601-603, each having a generally triangular cross-sectional shape. Each arm member 601-603 receives a trampoline frame member (not shown in FIGS. 6A-6C) of similar cross-sectional shape into an opening 604 (FIG. 6C). Sleeve-joint coupling 600 includes an opening 605, shown in FIG. 6B, that receives a safety enclosure vertical pole member (not shown in FIGS. 6A-6C) having a generally triangular cross-sectional member.

Figure 7B:
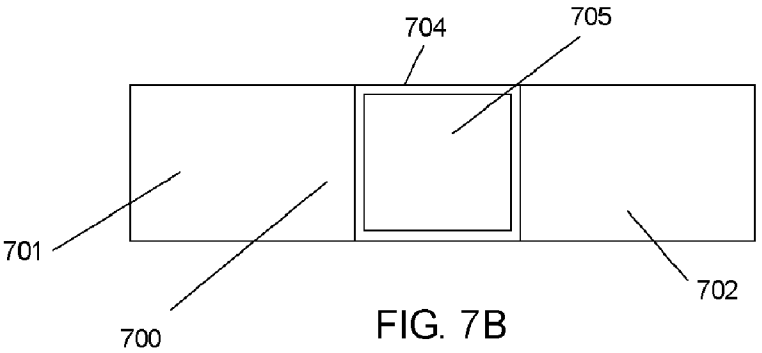
FIGS. 7A and 7B respectively show a side view and a top view of a fifth exemplary embodiment of a sleeve-joint coupling for a trampoline frame according to the present invention.
Figure 7A:
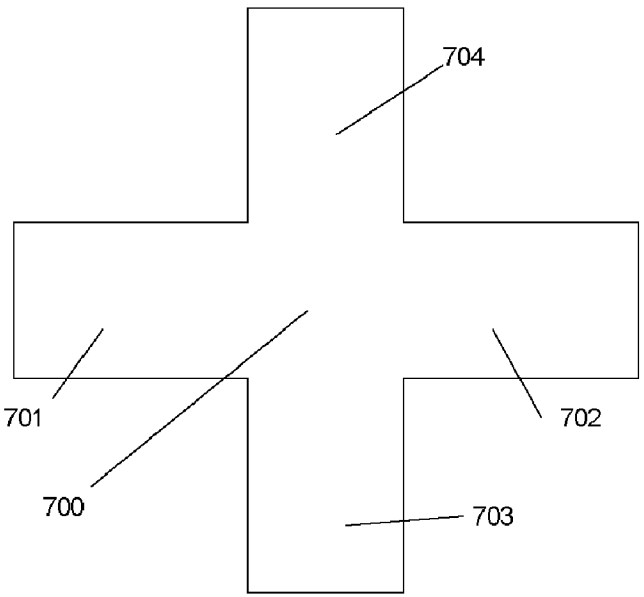

FIGS. 7A and 7B respectively show a side view and a top view of a fifth exemplary embodiment of a sleeve-joint coupling 700 for a trampoline frame according to the present invention. Sleeve-joint coupling 700 is generally shaped as an "X" or a "+" and includes four arm members 701-704, each having a generally square cross-sectional shape. Each arm member 701-704 receives a trampoline frame member (not shown in FIGS. 7A and 7B) of similar cross-sectional shape into an opening 705, of which only one opening 705 is shown (FIG. 7B). Each opening 705 receives a safety enclosure vertical frame member 103, a circular frame member 104 or a vertical pole member 105 (none of which are shown in FIGS. 7A and 7B) having a generally square cross-sectional member. It should be understood that sleeve-joint coupling 700 can have an alternative cross-sectional shape, such as any of the exemplary cross-sectional shapes described herein, and a mating vertical frame member, circular frame member and vertical pole member would have a corresponding cross-sectional shape.

Figures 8A, 8B, 8C:
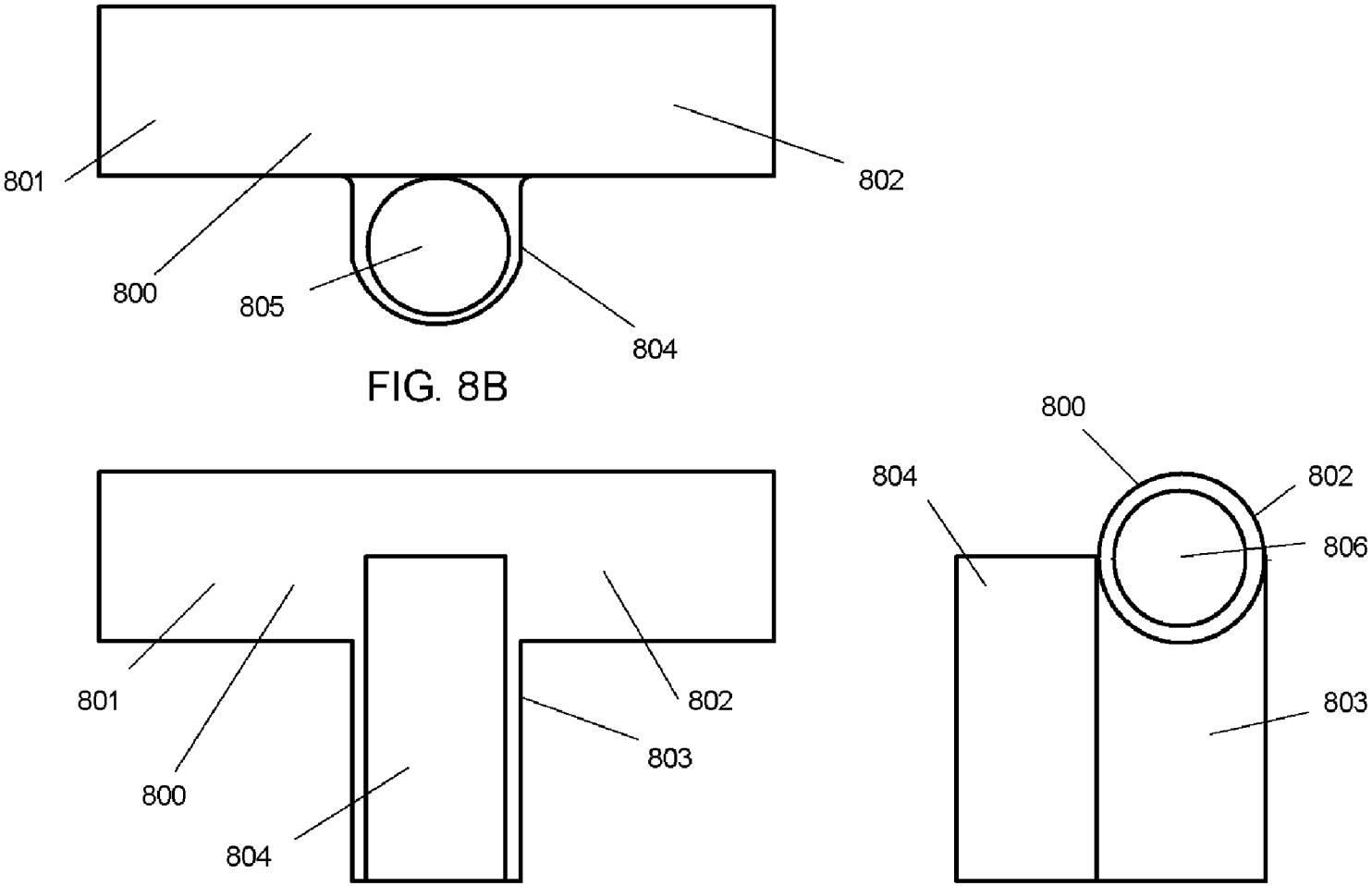
FIGS. 8A-8C respectively show a side view, a top view and an end view of a sixth exemplary embodiment of a sleeve-joint coupling for a trampoline frame according to the present invention.

FIGS. 8A-8C respectively show a side view, a top view and an end view of a sixth exemplary embodiment of a sleeve-joint coupling 800 for a trampoline frame according to the present invention. Sleeve-joint coupling 800 is generally shaped as a "T" and includes three arm members 801-803, each having a generally round cross-sectional shape. Sleeve-joint coupling 800 also includes a side sleeve member 804 having an aperture 805, configured as a blind hole, that receives a safety enclosure vertical pole member (not shown in FIGS. 8A-8C) having a generally round cross-sectional member. Side sleeve member 804 has sufficient length and strength to allow a safety enclosure vertical pole to extend into side sleeve member 804 so that the vertical pole would not come out during use. Each arm member 801-803 receives a trampoline frame member (also not shown in FIGS. 8A-8C) of similar cross-sectional shape into an opening 806 (FIG. 8C). In an alternative embodiment, aperture 805 could be configured to allow a safety enclosure vertical pole to extend through the length of the side sleeve member 804 to the ground or to another device that fastens the vertical pole to the corresponding frame member 103.

Figure 9:
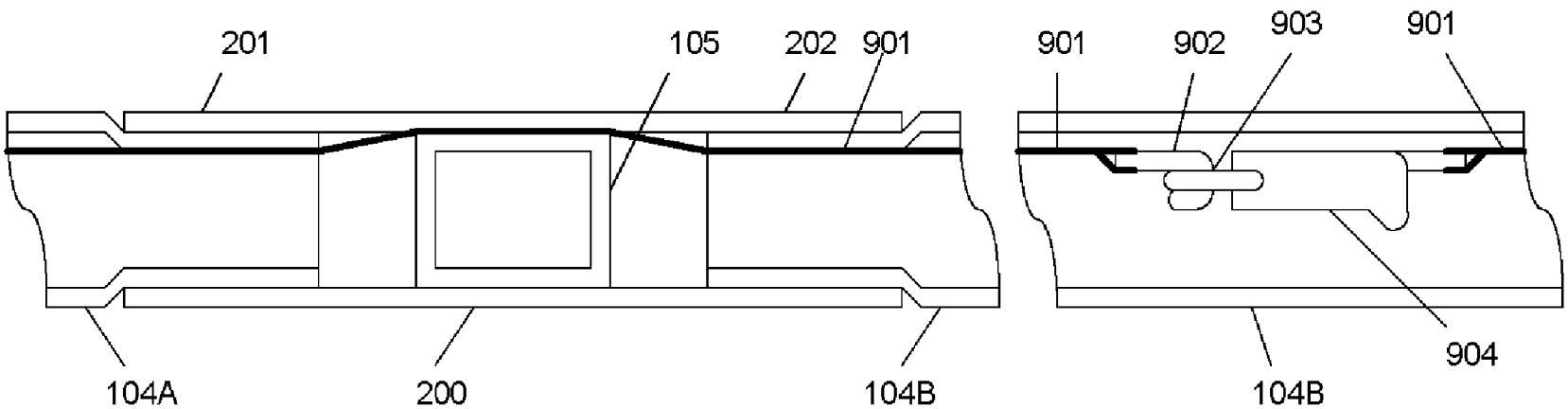
FIG. 9 depicts a top cutaway view of the first exemplary embodiment of a sleeve-joint coupling according to the present invention.

FIG. 9 depicts a top cutaway view of the first exemplary embodiment of a sleeve-joint coupling 200 according to the present invention. Two circular frame members 104A and 104B are shown in FIG. 9 respectively engaging arm members 201 and 202 of sleeve-joint coupling 200. A vertical pole member 105 of a safety enclosure is also shown. A frame tension member 901, such as a strap of webbing, a wire or a cable, is shown threaded through circular frame members 104A and 104B and sleeve-joint coupling 200, in addition the other circular frame members and sleeve-joint coupling forming a trampoline frame. Frame tension member 901 is fastened in a well-known manner to a hook assembly 902 that engages a loop 903 of a buckle assembly 904 that is accessible through a hole (not shown) in circular frame member 104B. Buckle assembly 904 has two positions; an open position that allows hook assembly 902 and loop 903 to be conveniently engaged, and a closed assembly that places frame tension member 901 under tension. When frame tension member 901 is under tension, each sleeve-joint coupling 200 that frame tension member 901 passes through is urged toward the center of the trampoline frame structure, thereby making the joints of frame structure even more reliable. Alternatively, a plurality of frame tension members can be used to form a line of continuous tension around a trampoline frame instead of a single frame tension member, as depicted in FIG. 9. As yet another alternative, frame tension member 901 could be attached to the outside of sleeve-joint coupling 200, such as through a loop fastened to the outside of sleeve-joint coupling 200. Still another alternative provides that a turn-buckle arrangement is used for placing tension on frame tension member 901.

While exemplary trampoline 100 shown in FIG. 1 is depicted as being round, it should be understood that the present invention could be used with a trampoline and safety enclosure having a different shape, such as square, rectangular or oval. Additionally, the sleeve-joint coupling of the present invention can be made from any suitable material that has sufficient strength to bear the loads and stresses that are associated with trampolines, such as metals and plastics. Further, while the sleeve-joint coupling of the present invention has been described in terms of vertical frame members and circular frame members fitting into the sleeve-joint coupling, it should be understood that the sleeve-joint coupling of the present invention can be configured so that one or all of the arm members of the sleeve-joint coupling fit into vertical frame members and circular frame members of the trampoline frame. Further still, while the sleeve-joint coupling of the present invention has been described as having several exemplary cross-sectional shapes, it should be understood that a sleeve-joint coupling according to the present invention could have any cross-sectional shape or have arm members having different cross-sectional shapes. As yet another alternative, the sleeve-joint coupling of the present invention could be formed to be part of a vertical frame member. As still another alternative, the sleeve-joint coupling of the present invention could be configured to substantially form a "T".

While the vertical pole members 105 of safety enclosure 101 has been described as extending into vertical frame members 103, it should be understood that at least one or more vertical pole member 105 of safety enclosure 101 could extend to the ground along the outside of a vertical frame member 103, in which case such a vertical pole member would be attached to the corresponding vertical frame member at a minimum of two places, such as by using a sleeve-joint coupling similar to that shown in FIGS. 8A-8C and, for example, a tie-wrap device near the bottom of a vertical frame member 103.

Figure 11:
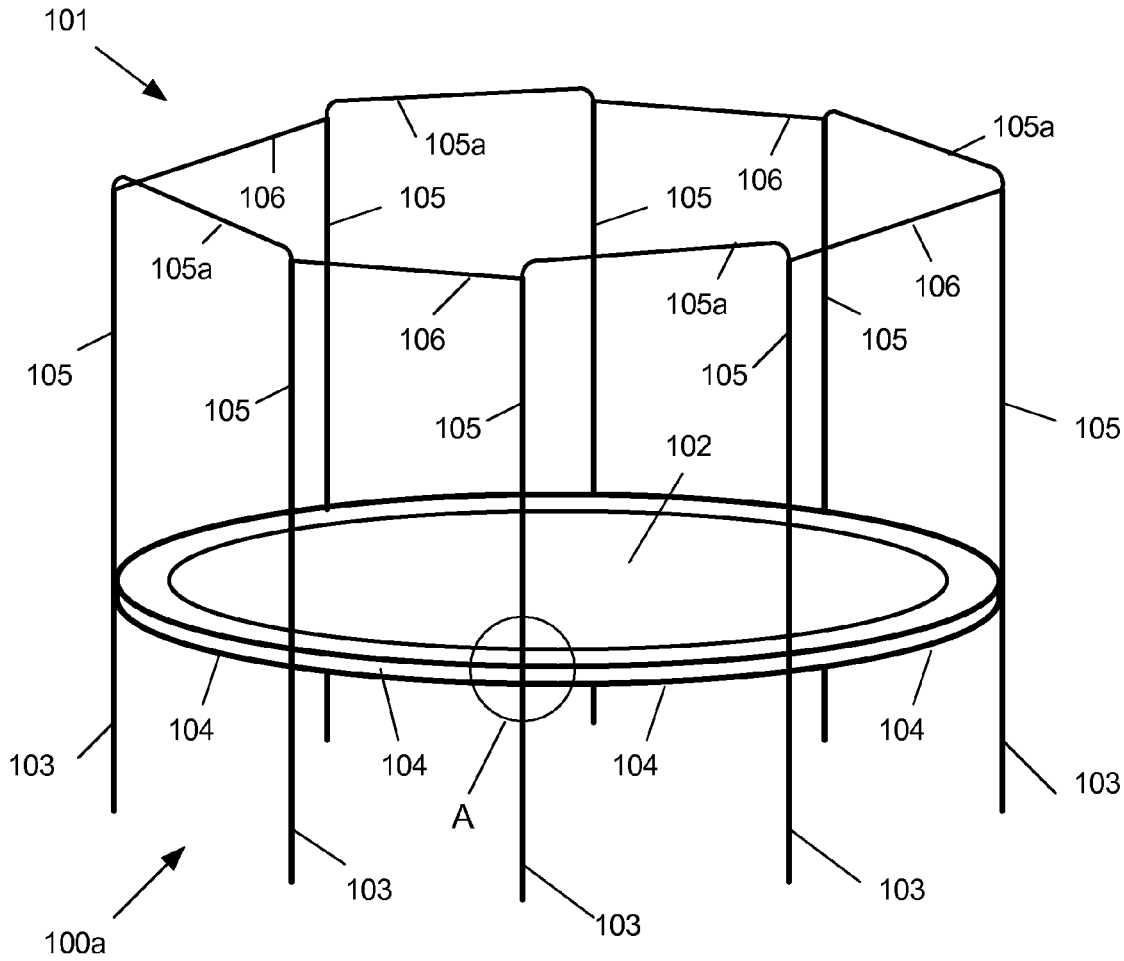
FIG. 11 depicts a perspective view of an exemplary trampoline having an exemplary alternative embodiment of a safety enclosure.

As yet another alternative embodiment, a safety enclosure vertical pole member 105 could be configured to form an arch (105*a* of trampoline 100*a* in FIG. 11), or an arc shape, between two frame members 103. The two frame members 103 could be adjacent or could be separated by one or more other frame members 103. A horizontal support member would then be connected between adjacent peaks of an arch in a substantially inflexible manner.

Figure 10:
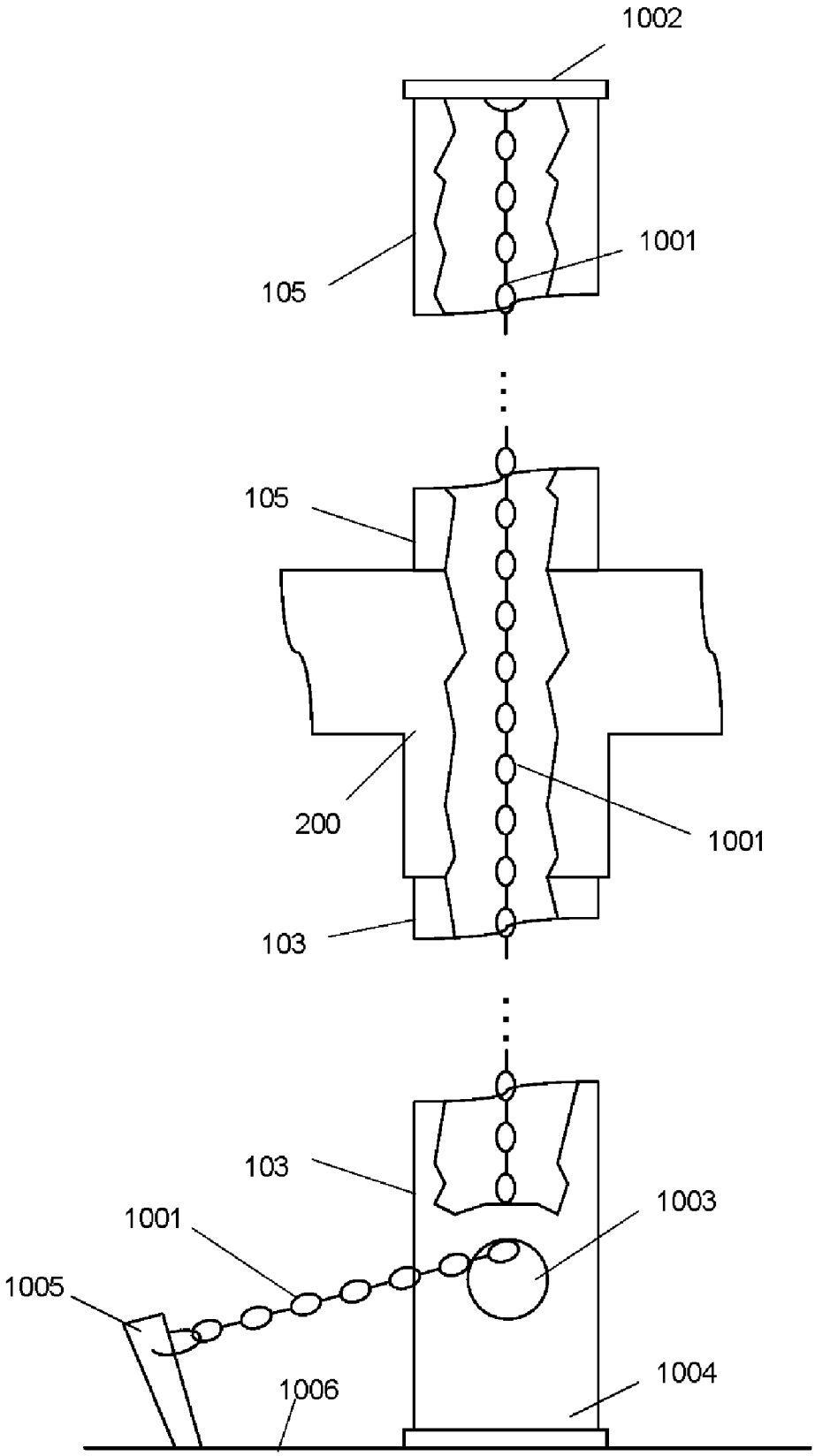
FIG. 10 shows a cut-away view of an exemplary embodiment of a vertical pole member for a safety enclosure, a sleeve-joint coupling, and a vertical frame member according to the present invention.

FIG. 10 shows a cut-away view of an exemplary embodiment 1000 of a vertical pole member 105 for a safety enclosure 101, a sleeve-joint coupling 200, and a vertical frame member 103 according to the present invention. Embodiment 1000 includes a tension member 1001, such as a chain, that is attached in a well-known manner to a cap 1002. Tension member 1001 extends from cap 1002 through vertical pole member 105, sleeve-joint coupling 200 and vertical frame member 103 and emerges from an opening 1003 near the base 1004 of vertical frame member 103. The portion of tension member 1001 that emerges from opening 1003 is attached to a ground-fastening device 1005, such as a stake. In use, tension member 1001 is pulled tight and stake 1005 is staked to the ground 1006 so that vertical pole member 105, sleeve-joint coupling 200 and vertical frame member 103 remain assembled as a unitary structure as trampoline 100 (FIG. 1) is being used. That is, tension member 1001 applies a force between a vertical pole member 105 and a vertical frame member that compresses the vertical pole member toward the vertical frame member. Stake 1005 provides the additional benefit of fastening trampoline 100 to the ground so that trampoline 100 does not have a tendency to move while in use or during high-wind conditions. Tension member 1001 is of sufficient length to allow vertical pole member 105, sleeve-joint coupling 200 and vertical frame member 103 to be disassembled, conveniently packed into a shipping box and remain coupled together.

It should be understood that while only one vertical pole member 105, one sleeve-joint coupling 200, and one vertical frame member 103 are shown in FIG. 10, a tension member 1001, an opening 1003 and stake 1005 should be used at each location that a vertical pole member 105 of a safety enclosure 101 is attached to a sleeve-joint coupling 200 and a vertical frame member 103 for maximum benefit. Additionally, while tension member 1001 is depicted in FIG. 10 as a chain, it should be understood that a rope, cord, cable and/or strap could be used that has sufficient strength, weatherability and durability to meet the stresses and weather conditions that would be expected for a recreational structure. Further still, while tension member 1001 has been depicted as internal to vertical pole member 105, sleeve-joint coupling 200 and vertical frame member 103, it should be understood that tension member 1001 could be arranged to be completely external and fastened along side each of or any one of vertical pole member 105, sleeve-joint coupling 200 and vertical frame member 103. It should also be understood that while ground-fastening device 1005 is depicted as a stake, other ground-fastening devices could be used such as a screw-shaped stake or a buried anchor.

Although the foregoing invention has been described in some detail for purposes of clarity of understanding, it will be apparent that certain changes and modifications may be practiced that are within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A recreational structure frame system, comprising:

a plurality of horizontal frame members, each horizontal frame member comprising two ends;

at least one vertical frame member, each vertical frame member comprising two ends;

at least one vertical pole member, each vertical pole member comprising two ends;

at least one sleeve-joint coupling comprising first, second and third arm members and an aperture formed in the sleeve-joint coupling, the first arm member and the aperture being disposed in an opposite relationship with respect to each other, the second arm member and the third arm member being disposed in an opposite relationship with each other, the first arm member receiving one end of a vertical frame member, the aperture receiving one end of a vertical pole member, the vertical frame member being received by the first arm member and the vertical pole member received by the aperture comprising a co-linear relationship with respect to each other, and the second and third arm members each receiving one end of a horizontal frame member; and a tension member applying a force between a vertical frame member and a corresponding vertical pole member that compresses the vertical frame member toward the corresponding vertical pole member.

2. The recreational structure frame system according to claim 1, wherein the vertical pole member received by the aperture extends through the sleeve-joint coupling into an inner portion of the vertical frame member received by the first arm of the sleeve-joint coupling.

3. The recreational structure frame system according to claim 1, wherein the vertical pole member comprises part of a safety enclosure.

4. The recreational structure frame system according to claim 3, wherein the safety enclosure comprises a plurality of vertical pole members, each vertical pole member being received into the aperture of a sleeve-joint coupling, and a plurality of horizontal support members, each horizontal support member being coupled to two adjacent vertical pole members.

5. The recreational structure frame system according to claim 1, further comprising a rebounding surface coupled to the horizontal frame members.

6. The recreational structure frame system according to claim 1, wherein the sleeve-joint coupling comprises a fourth arm member, the aperture being disposed at an end of the fourth arm member.

7. The recreational structure frame system according to claim 1, further comprising a frame tension member coupled between adjacent sleeve-joint couplings, the frame tension member applying a force to the adjacent sleeve-joint couplings and forcing the adjacent sleeve-joint couplings toward each other.

8. The recreational structure frame system according to claim 1, further comprising a plurality of frame tension members, each frame tension member being coupled between at least two adjacent sleeve-joint couplings and applying a force to the adjacent sleeve-joint couplings to force the adjacent sleeve-joint couplings toward each other.

9. The recreational structure frame system according to claim 1, wherein the first, second and third arm members of at least one sleeve-joint coupling are arranged to substantially form a "T" configuration.

10. The recreational structure frame system according to claim 1, wherein at least one sleeve-joint coupling comprises a side sleeve member, and wherein the aperture comprises part of the side sleeve member.

11. The recreational structure frame system according to claim 1, wherein the vertical pole member substantially forms an arch.

12. The recreational structure frame system according to claim 1, wherein the tension member comprises one of a chain, cord, rope, cable and strap.

13. The recreational structure frame system according to claim 1, wherein the tension member is internal to the vertical frame member and the corresponding vertical pole member.

14. The recreational structure frame system according to claim 13, wherein the tension member extends through an opening in the vertical pole member, and the recreational structure frame system further comprising a ground-fastening device coupled to a portion of the tension member that extends through the opening in the vertical frame member.

15. The recreational structure frame system according to claim 1, further comprising a ground-fastening device coupled to a portion of the tension member that is distal to the vertical pole member.

16. The recreational structure frame system according to claim 1, wherein the recreational structure comprises at least part of a trampoline frame structure.

* * * * *